US009970245B2

(12) United States Patent
Speer et al.

(10) Patent No.: US 9,970,245 B2
(45) Date of Patent: May 15, 2018

(54) DUAL CIRCULATION DRILLING SYSTEM

(71) Applicant: Strada Design Limited, St. Helier OT (JE)

(72) Inventors: Ian Speer, Gooseberry Hill (AU); Warren Strange, Bicton (AU)

(73) Assignee: Strada Design Limited, St. Helier (JE)

( * ) Notice: Subject to any disclaimer, the term of this patent is extended or adjusted under 35 U.S.C. 154(b) by 150 days.

(21) Appl. No.: 14/976,641

(22) Filed: Dec. 21, 2015

(65) Prior Publication Data

US 2016/0108686 A1 Apr. 21, 2016

Related U.S. Application Data

(63) Continuation of application No. 14/353,137, filed as application No. PCT/AU2013/000044 on Jan. 21, 2013, now Pat. No. 9,316,052.

(30) Foreign Application Priority Data

Jan. 20, 2012 (AU) ..... 2012900235

(51) Int. Cl.
*E21B 21/00* (2006.01)
*E21B 4/14* (2006.01)
(Continued)

(52) U.S. Cl.
CPC ..... *E21B 21/002* (2013.01); *E21B 1/00* (2013.01); *E21B 4/14* (2013.01); *E21B 7/18* (2013.01);
(Continued)

(58) Field of Classification Search
CPC ..... E21B 21/002; E21B 21/08; E21B 1/00; E21B 17/1078; E21B 17/18; E21B 7/18;
(Continued)

(56) References Cited

U.S. PATENT DOCUMENTS 3,534,822 A * 10/1970 Campbell ..... E21B 21/12 175/205
4,071,101 A 1/1978 Ford
(Continued)

FOREIGN PATENT DOCUMENTS

| | | |
|---|---|---|
| WO | 2000/026576 | 5/2000 |
| WO | 2003/071091 | 8/2003 |
| WO | 2012/006110 | 1/2012 |

OTHER PUBLICATIONS

International Search Report and Written Opinion for International Application No. PCT/AU2013/000044 dated May 16, 2013 (16 pages).

*Primary Examiner* — Brad Harcourt
(74) *Attorney, Agent, or Firm* — Michael Best & Friedrich LLP

(57) ABSTRACT

A ground drill system 10 has a drill string 14 which forms first and second mutually isolated fluid paths 16 and 18 respectively. The drill string 14 has an up hole end 20 coupled to a dual circulation rotation head 22 and a down hole end 24 which is coupled to a drilling tool 12. The drilling tool 12 is operated by the flow of fluid delivered through the first flow path 16. A second fluid outlet 26 is provided intermediate the up hole end 20 and the drilling tool 12. The outlet 26 is in fluid communication with the second fluid flow path 18 and located a constant or fixed distance from the drilling toll 12. The second fluid outlet 26 discharges a flushing fluid flowing through the flushing flow path 18 into a hole being drilled by the drilling system 10. The rotation head 22 provides torque to the drill string 14 and thus the drilling tool 12.

10 Claims, 2 Drawing Sheets

(51) Int. Cl.

| | |
|---|---|
| ***E21B 21/12*** | (2006.01) |
| ***E21B 7/18*** | (2006.01) |
| ***E21B 17/18*** | (2006.01) |
| ***E21B 1/00*** | (2006.01) |
| ***E21B 17/10*** | (2006.01) |
| ***E21B 21/08*** | (2006.01) |
| *E21B 21/10* | (2006.01) |

(52) U.S. Cl.
CPC ..... *E21B 17/1078* (2013.01); *E21B 17/18* (2013.01); *E21B 21/08* (2013.01); *E21B 21/12* (2013.01); *E21B 21/103* (2013.01); *E21B 2021/006* (2013.01)

(58) Field of Classification Search
CPC ..... E21B 4/14; E21B 21/12; E21B 21/2013; E21B 2021/006
See application file for complete search history.

(56) References Cited

U.S. PATENT DOCUMENTS

| | | | | |
|---|---|---|---|---|
| 4,694,911 | A | 9/1987 | Kennedy | |
| 5,497,839 | A * | 3/1996 | Moir | E21B 21/12 175/215 |
| 6,484,816 | B1 | 11/2002 | Koederitz | |
| 2002/0170749 | A1 | 11/2002 | Hoyer et al. | |
| 2007/0137897 | A1 | 6/2007 | Sanders et al. | |
| 2008/0156487 | A1 | 7/2008 | Zazovsky et al. | |
| 2009/0173543 | A1 | 7/2009 | Zupanick | |
| 2010/0258303 | A1 | 10/2010 | Alberty | |
| 2012/0175113 | A1 * | 7/2012 | Bullock | E21B 21/14 166/278 |

* cited by examiner

DUAL CIRCULATION DRILLING SYSTEM

CROSS-REFERENCE TO RELATED APPLICATIONS

This patent application is continuation of Ser. No. 14/353,137, filed Apr. 21, 2014, which is a national stage filing under 35 U.S.C. 371 of International Application No. PCT/AU2013/000044, filed on Jan. 21, 2013, which claims the benefit of Australian Patent Application No. 2012900235, filed on Jan. 20, 2012, the disclosures of which are incorporated by reference herein in their entireties. Priority to each application is hereby claimed.

BACKGROUND OF THE INVENTION

A system and method are disclosed for drilling a hole in the ground for example exploration or production holes.

Many types of ground drilling systems are available for drilling holes for particular purposes and in specific ground conditions. One range of down hole drill systems utilise a fluid under pressure to assist in advancing the drill. The fluid may act to either drive a drilling tool coupled to an associated drill string, or to flush drill cuttings from a hole being drilled, or both. The fluid can be gas such as air or nitrogen, a liquid/slurry such as water or drilling mud, or a combination of gas and liquid.

SUMMARY OF THE INVENTION

In broad terms a drilling system and method are disclosed in which a first fluid is used to operate a down the hole drilling tool, while a second fluid is used to assist in the drilling process, the fluids being isolated from each other while at least flowing down the hole. This assistance includes but is not limited to flushing drill cuttings from the hole and controlling downhole pressure conditions in the hole. When drilling in relation to hydrocarbons the control of downhole pressure includes to provide either overbalanced, underbalanced or balanced pressure conditions. The system and method also facilitate the killing of a well by pumping a second fluid such as cement or mud having a very high specific gravity through the second fluid flow path.

Since the first and second flow paths are separate it is possible to optimise the fluids for their specific purposes. For example the first fluid which is used to operate the drilling tool drill can be provided as a fluid that is optimum for operating the drilling tool in terms of power, speed, efficiency and longevity of the tool. On the other hand the second fluid may be optimised in terms of clearing the hole of drill cuttings, hole stability and providing a desired downhole pressure condition, either by itself or when mixed with the first fluid in the event that the first fluid is into the hole exhausted after operating the tool. The parameters or characteristic that may selected for the second fluid include but are not limited to: up hole velocity, viscosity and specific gravity.

The drilling system and method may be used for example with a downhole tool in the form of a down the hole hammer, be it conventional or reverse circulation. While downhole hammers are used extensively in hard ground conditions they do not find favour in oil and gas exploration or production. One reason for this is the compromise between efficiency and safely. The best fluid for operating the hammer is not often the best fluid for maintaining or controlling downhole pressure conditions and maintaining hole stability. Conversely the best fluid to maintain or control downhole pressure conditions often has a high specific gravity and additives which, if used to operate a down the hole hammer would accelerate wear. This means that the associated drill string needs to be tripped more regularly. In turn this significantly increases drilling costs due to down time.

The first fluid may be denoted as a "working fluid" as this is the fluid that operates the down the hole drilling tool. In various embodiments the first fluid may comprise, but is not limited to: water, oil, air, nitrogen gas, or mixtures thereof.

The second fluid may be denoted as a "flushing fluid" as it has a predominate, but not sole, purpose of flushing drill cutting form the hole. In one embodiment the flushing fluid may comprise, but is not limited to: water or drilling mud.

In one aspect there is provided a ground drilling system comprising:

a drill string arranged to form a flushing fluid flow path and a working fluid flow path that are fluidically isolated from each other, the drill string having an up hole end and an opposite down hole end;

a fluid operated drilling tool coupled to the down hole end of the drill string and in fluid communication with the working fluid flow path wherein the fluid operated drilling tool is operated by a working fluid flowing through the working fluid flow path; and, a flushing fluid outlet in communication with the flushing fluid flow path, the flushing fluid outlet juxtaposed at a fixed location relative to the drilling tool and carried by the drill string wherein the flushing fluid outlet advances with the drill string, the flushing fluid outlet capable of directing a flushing fluid flowing through the flushing fluid flow path into a hole being drilled by the ground drilling system.

In one embodiment the flushing fluid outlet is located so that flushing fluid flowing from the flushing fluid outlet enters the hole near the toe of the hole.

In one embodiment the flushing fluid outlet is located adjacent to the drilling tool.

In one embodiment the flushing fluid outlet is arranged to direct the flushing fluid in an up hole direction.

In one embodiment the ground drill system comprises a well control valve system operable to control flow of fluid flowing through the flushing fluid path and out of the flushing fluid outlet.

In one embodiment the flushing fluid outlet comprises a plurality of outlet ports formed about an outer circumference of the drill string.

In one embodiment the well control valve system is arranged to enable flow of fluid only in a direction out of the flushing fluid outlet.

In one embodiment the well control valve system comprises a plurality of individual valves, one provided for each outlet port.

In one embodiment the ground drill system comprises a hole stabiliser coupled up hole of and near the drilling tool, the hole stabiliser operable to maintain the drilling tool in a substantially central location within a hole being drilled during operation of the drilling tool.

In one embodiment the hole stabiliser is formed with an outer diameter marginally less than an inner diameter of the hole being drilled.

In one embodiment the hole stabiliser comprises a plurality of circumferentially spaced apart and axially extending protrusions.

In one embodiment the well control valve is disposed within the hole stabiliser.

In one embodiment the flushing fluid outlet ports are formed one in each of the protrusions.

In one embodiment the working fluid flow is provided with an opening at the drilling tool wherein the working fluid is exhausted into the hole.

In one embodiment the working fluid flow path is a closed flow path and arranged to recirculate working fluid through the drilling tool.

In one embodiment the working and flushing fluids are discharged at the bottom of the hole.

In one embodiment the drill string comprises:

an inner conduit having an axial bore forming one of the working and flushing fluid flow paths; and, an outer conduit having an axial bore;

wherein the inner conduit extends through the axial bore of the outer conduit and a space between the inner conduit and the outer conduit forms the other of the working and flushing flow paths.

In an alternate embodiment the drill string comprises:

an inner conduit, an intermediate conduit and an outer conduit, each of the conduits having an axial bore and the conduits arranged with the inner conduit located inside the intermediate conduit and the intermediate conduit inside the outer conduit to form a first annular space between the inner conduit and the intermediate conduit, and a second annular space between the intermediate conduit and the outer conduit;

wherein the inner conduit and the first annular space are in fluid communication with the drilling tool and together form at least a portion of the closed loop flow path for the working fluid, and the second annular space forms the flushing fluid flow path.

In the alternate embodiment the drill string comprises a tubular member having an axial bore and supporting first and second conduits disposed inside the axial bore, and the first and second conduits are arranged to coupled with the drilling tool for form at least a portion of the closed loop path for the working fluid wherein working fluid is able to flow from an up hole end through the first conduit to operate the drilling tool and return to the up hole end through the second conduit.

In one embodiment the inner conduit extends axially beyond the at least one outer conduit at the up hole end of the drill string.

In one embodiment the ground drill system comprises a rotation head arranged to couple to the up hole end of the drill string, the rotation head arranged to provide torque to the drill string.

In one embodiment the drilling tool is a DTH hammer.

In a second aspect there is disclosed a ground drilling system comprising a drill string configured to form a working fluid flow path and a flushing fluid flow path that are fluidically isolated from each other within the drill string;

a fluid operated percussion drilling tool coupled to one end of the drill string and in fluid communication with the working fluid flow path wherein working fluid flowing through the working fluid flow path is able to operate the drilling tool; and a flushing fluid outlet on the drilling string through which flushing fluid flowing in the flushing fluid flow path is able to flow into a hole being drilled by the ground drill.

In each of the first and second aspects, rotation of the drill string causes rotation of the drilling tool. It also of course causes rotation of the flushing fluid outlet. Thus drilling is achieved by a combination of rotation caused by rotation of the drill string and percussion caused by the working fluid operating the drilling tool. Flushing of the hole being drilled, as well as control of hydrostatic pressure in the hole and hole stability is controlled or otherwise determined by the flushing fluid and its specific characteristics. Additionally the second aspect may also take each of the embodiments described above in relation to the first aspect.

In a third aspect there is disclosed a method of drilling a hole in the ground using a fluid operated drilling tool, the method comprising:

delivering a working fluid through a drill string to the drilling tool to operate the drilling tool;

delivering a flushing fluid through the drill string toward the drilling tool wherein the flushing fluid while flowing in the drill string is isolated from the working fluid; and, releasing the flushing fluid from a location that is fixed with respect to the drilling tool into a hole being drilled by the drilling tool wherein the location advances with the drill string.

In one embodiment the method comprises releasing the working fluid into the hole near a toe of the hole to enable a mixing of the working fluid and the flushing fluid in the hole.

In one embodiment the method comprises separating the working fluid from the flushing fluid and any entrained drill cuttings and reusing the separated working fluid as, or in, the working fluid being delivered through the drill string to operate the drilling tool.

In an alternate embodiment the method comprises recirculating the working fluid through the drill string wherein the working fluid is not mixed with the flushing fluid in the hole.

In each embodiment the method comprises adjusting down hole pressure by varying a physical characteristic of one or both of the flushing fluid and the working fluid.

In one embodiment the method comprises adjusting one or both of the specific gravity and the viscosity of the flushing fluid.

In one embodiment adjusting down hole pressure comprises dynamically adjusting down hole pressure to provide a desired pressure condition in the hole.

In one embodiment the method comprises dynamically adjusting down hole pressure in a manner to provide an underbalanced pressure condition in the hole.

In one embodiment the method comprises dynamically adjusting down hole pressure in a manner to provide an overbalanced pressure condition in the hole.

In one embodiment the method comprises dynamically adjusting down hole pressure in a manner to provide a balanced pressure condition in the hole.

In one embodiment the method comprises releasing the flushing fluid at a location near the drilling tool.

In one embodiment the method comprises changing a direction of flow of the flushing fluid from a down hole direction to an up hole direction prior to releasing the flushing fluid into the hole.

In one embodiment the method comprises providing the working and flushing fluids as fluids of different specific gravity.

In one embodiment the method comprises providing the working and flushing fluids as fluids of different viscosity.

In one embodiment the method comprises providing the working fluid as a fluid comprising water.

In one embodiment the flushing fluid is provided as one or a combination of one or more of: a drilling mud, water, and aerated water.

In one embodiment the method comprises providing the working and flushing fluids at the same pressure.

In one embodiment the method comprises providing the drilling tool as a down the hole hammer.

In a fourth aspect there is disclosed a method of drilling an exploration or production hole for a hydrocarbon, the method comprising:

coupling a drilling tool to a drill string;

using a surface based drill rig to rotate the drill string and provide pull down or pull up to the drilling tool;

delivering a working fluid through the drill string to operate the drilling tool;

delivering a flushing fluid through the drill string toward the drilling tool wherein the flushing fluid while flowing in the drill string is isolated from the working fluid;

releasing the flushing fluid from a location that is fixed with respect to the drilling tool into a hole being drilled by the drilling tool wherein the location advances with the drill string; and modifying one or more characteristics of the flushing fluid to control down hole pressure conditions independent of operating the drilling tool.

In one embodiment coupling a drilling tool comprises coupling a down the hole hammer.

In one embodiment the method comprises releasing the working fluid into the hole near a toe of the hole to enable a mixing of the working fluid and the flushing fluid in the hole.

In one embodiment the method comprises separating the working fluid from the flushing fluid and any entrained drill cuttings and reusing the separated working fluid as, or in, the working fluid being delivered through the drill string to operate the drilling tool.

In one embodiment the method comprises recirculating the working fluid through the drill string wherein the working fluid is not mixed with the flushing fluid in the hole.

In a fifth aspect there is disclosed a method of drilling an exploration or production well for a hydrocarbon, the method comprising:

using a surface based drill rig to rotate a down the hole drilling tool via a drill string;

providing a working fluid flow path in the drill string to enable a working fluid to flow through the drill string to operate the drilling tool;

providing a flushing fluid flow path in the drill string that is isolated from the working fluid flow path, the flushing fluid flow path having an outlet enabling a flushing fluid to exit the drill string and flow into a well being drilled by the drilling tool; and on detection of a blow out delivering a fluid through the flushing fluid flow path to kill the well.

BRIEF DESCRIPTION OF THE DRAWINGS

Notwithstanding any other forms which may fall within the scope of the system and method as set forth in the Summary, a specific embodiment will now be described by way of example only with reference to the accompanying drawing in which.

DETAILED DESCRIPTION

Figure 1:
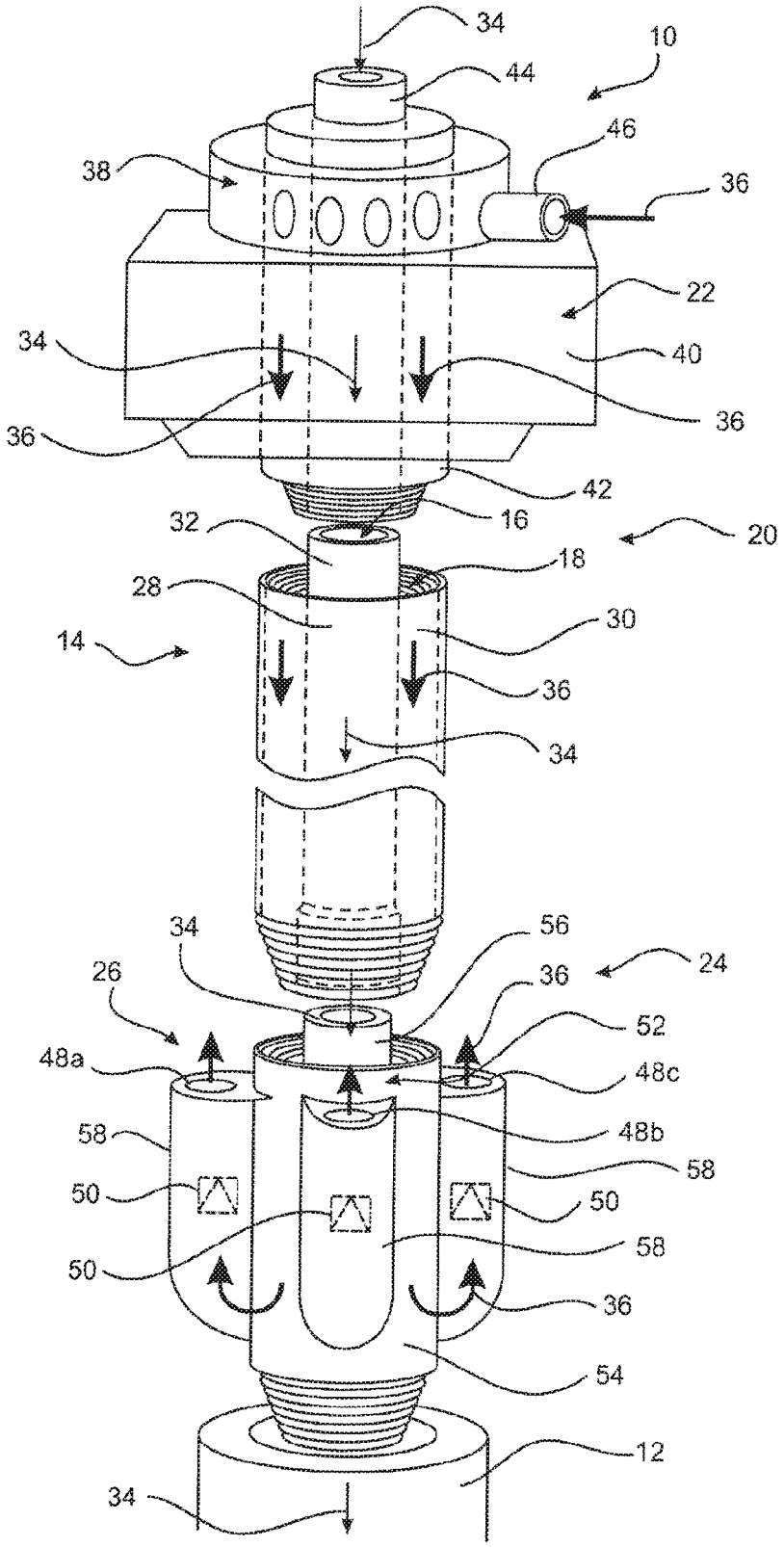
FIG. 1 is a schematic representation of a first embodiment of the ground drill system.

FIG. 1 provides a schematic representation of ground drill system 10 (hereinafter referred to in general as "drill system 10"). As will be explained in greater detail herein below, the drill system 10 enables the delivery of first and second fluids down a hole or well being drilled by the drill system 10. One of the fluids is used to operate a drilling tool 12 such as a water hammer while the other fluid is released into the hole upstream of the drilling tool 12. The combination of the two fluids can enable: drill cuttings to be brought to the surface; control over hydrostatic pressure to provide a desired over balanced or under balanced drilling conditions, or indeed the ability to change for one to the other; optimum operation and service life of the drilling tool; and maintenance of hole stability. By virtue of the use of the two fluids the system 10 may be described as a dual circulation well control system.

This embodiment of the system 10 comprises a drill string 14 which forms first and second mutually isolated fluid paths 16 and 18 respectively. When the first fluid is used to operate the drilling tool this fluid may be termed as the "working" fluid, and the corresponding fluid flow path may be termed as the "working" fluid flow path. When the second fluid is used to flush the hole and/or enable control of down hole pressure and/or hole stability, this fluid may be termed as the "flushing" fluid, and the corresponding fluid flow path may be termed as the "flushing" fluid flow path.

The drill string 14 has an up hole end 20 which is arranged to couple to a rotation head 22 and a down hole end 24 which is coupled to the drilling tool 12. The drilling tool 12 is operated by the flow of fluid delivered through the working flow path 16. A flushing fluid outlet 26 is provided intermediate the up hole end 20 and the drilling tool 12 and is in fluid communication with the flushing fluid flow path 18. The flushing fluid outlet 26 discharges a flushing fluid flowing through the flushing flow path 18 into a hole being drilled by the drilling system 10.

The drill string 14 comprises an inner conduit 28 having an axial bore which forms the working fluid path 16 and an outer conduit 30 having an axial bore through which the inner conduit 28 extends. The conduits 28 and 30 are relatively configured so as to form a space of a generally annular shape there between which forms the flushing flow path 18. The inner and outer conduits 28 and 30 are in themselves formed from one or more end to end joined inner and outer pipes. Additional inner and outer pipes are added to the drill string 14 in order to progress the drilling of the hole. An up hole end 32 of the inner conduit 28 extends axially beyond the outer conduit 30. The purpose of this is to avoid the entry of fluid flowing through the flushing flow path 18 into the working flow path 16 during disconnection of the drill string 14 from the rotation head 22.

The rotation head 22 provides torque to the drill string 14 and thus the drilling tool 12. That is the rotation head rotates the entirety of the drill string and thus the drilling tool 12. In addition the rotation head provides a mechanism for delivering the working fluid 34 (shown by thin arrows) and a flushing fluid 36 (shown by thick arrows) to the working and flushing fluid flow paths 16 and 18 respectively. Due to the ability to feed two fluids through the drill string 14 the rotation head 22 may be designated as a dual circulation rotation head. The rotation head 22 comprises in combination a dual circulation inlet swivel 38 which is rotationally stationary, and a rotation head 40 provided with motors (not shown) for imparting torque to a connecting stub 42 which in turn transmits torque to a connected drill string 14 and drilling tool 12. The swivel 38 is provided with working fluid inlet 44 and a flushing fluid inlet 46.

The rotation head is supported on a drill rig (not shown) which may be either fixed or mobile. The drill rig comprises a tower along which the rotation head is linearly traversed by some type of system to enable addition or break out of drill pipes and provide pull back of hold down force to the drilling tool. The system may comprise hydraulic rams and/or winches.

The flushing fluid outlet 26 in this embodiment is located adjacent the drilling tool 12 and exhausts the flushing fluid near the toe of the hole/well being drilled. Further in this example the outlet 26 comprises four outlet ports 48, only three of which are visible in FIG. 1. The outlet 26 is arranged to change the direction of flow of the flushing fluid 36 flowing in the flushing fluid flow path 18 by 180° prior to discharge into the hole. Thus the flushing fluid 36 exiting the flushing fluid outlet 26/outlet ports 48 is directed to flow in an up hole direction from a location adjacent the drilling tool 12 and toe of the hole.

The flow of flushing fluid through the outlet ports 48 is controlled by a well control valve system. The well control valve system operates to allow flow of the flushing fluid 36 in one direction only this being from the outlet ports 48 in the up hole direction, and prevents a back flow of fluid in a counter direction into the outlet ports 48. In the present illustrated embodiment the well control valve system comprises a plurality of one way valves 50, one for each of the outlet ports 48.

The well control valve system (i.e. one way valves 50) can be controlled to switch between an open state and a closed state. In the open state, the valves 50 operate as a normal one way valve allowing fluid flow through the protrusions 58 in an up hole direction and preventing a reverse direction fluid flow. In the closed state the valves 50 prevent the fluid flow in both directions.

The flushing fluid outlet 26 and the well control valve are incorporated in a hole stabiliser 52 which is coupled between a down hole end 24 of drill string 14 and the drilling tool 12. The hole stabiliser 52 operate to prevent the drilling tool 12 from moving sideways while drilling through faults and changing ground. To this end, the stabiliser 52 is formed to have an outer diameter to substantially match the diameter of the hole being drilled and may have a diameter approximately 1/16" less than the diameter of the drawing tool 12. The stabiliser 52 has a cylindrical outer body 54 which threadingly couples at opposite ends to the outer conduit 30 and the drilling tool 12. An axially extending inner conduit 56 is supported in the body 54 and provides fluid communication between the inner conduit 28 and the drawing tool 12 to allow the passage of the working fluid 34 to operate the drilling tool 12.

A plurality of circumferentially spaced and axially extending protrusions 58 are formed on and about the cylindrical body 54. The protrusions are provided with respective fluid flow channels which communicate with the region between the outside of the inner conduit 56 and the inside of the cylindrical body 54; and corresponding outlet ports 48. Thus the flushing fluid 36 which enters through inlet port 46 on the inlet swivel 38 flows in a down hole direction through the flushing flow path 18 into the cylindrical body 54, changes flow direction in flowing into an up corresponding channels in the protrusions 58 and finally is discharged out of the outlet ports 48. The one way valves 50 are also disposed within the protrusions 58 and allow the fluid 36 to flow in the up hole direction to the corresponding outlet 48 but prevent a reverse flow of fluid from the outlet 48 into the flushing fluid flow path 18.

In a specific embodiment of the system 10, the drilling tool 12 may be a water down the hole ("DTH") hammer operated by clean water (5μ). This clean water is delivered from the inlet 34 through the working fluid flow path 16 and inner conduit 56. Further in this embodiment the water (i.e. working fluid) passing through the water hammer 12 is exhausted from outlets near the down hole end of the water hammer 12 and flows back up the hole being drilled. In an alternate embodiment described below the working fluid is recirculated rather than being exhausted into the hole. The flushing fluid 36 may comprise a drilling mud, aerated water, water or other fluids of a desired or required viscosity and/or specific gravity/weight having regard to the down hole conditions. The flushing fluid enters through the inlet 46 on the inlet swivel 38 passes through the flushing fluid flow path 18 into the cylindrical body 54 of hole stabiliser 52 and changes direction flowing back up the projections 58 through one way valves 50 and finally the outlets 48. This fluid is directed to flow in the up hole direction from a location above the water hammer 12 but near the toe of the hole. The directing of the flushing fluid 36 in this manner assists with drill cutting removal from the hole. Further, the flushing fluid allows an operator to kill the well or adjust the fluid weight within the hole while drilling without changing the viscosity of water flowing through the water hammer 12.

By providing the flushing fluid 36 independently of the working fluid 34 the two fluids can be combined to provide total fluid weight required to drill in either over balanced or under balanced conditions. Over balanced conditions occur when the weight of the fluid (i.e. mud) is heavier than the ground pressure from gas or steam and thus prevents the gas or steam from rushing to the surface.

In one embodiment the fluids 34 and 36 are delivered at the same pressure which may range for example from between 3000 psi to or over 5000 psi for operating deep under high ground formation pressures.

Figure 2A:
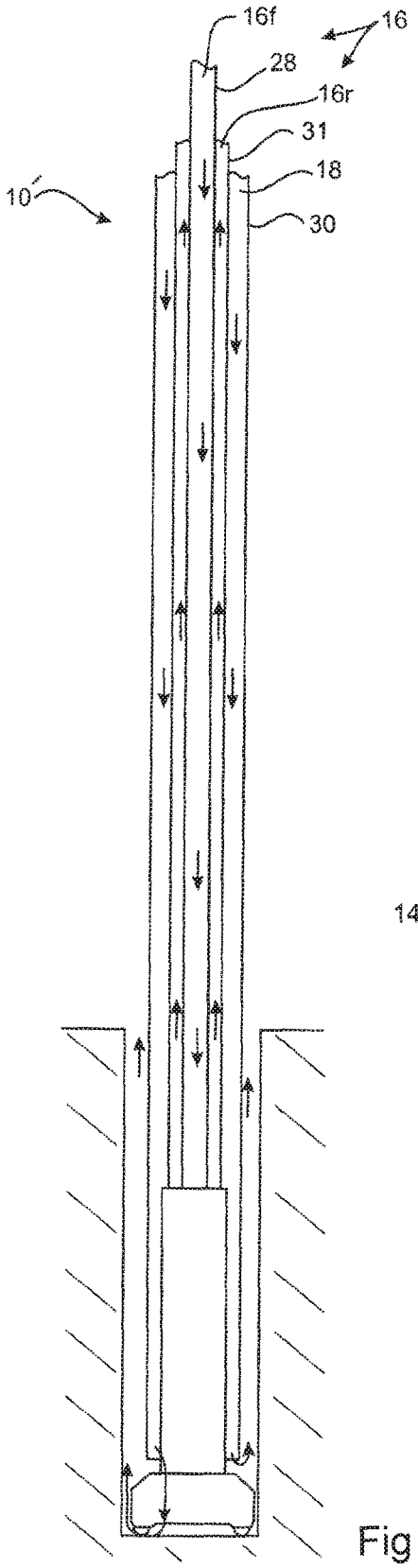
FIG. 2*a* is a section view of a portion of a second embodiment of the ground drilling system.
Figure 2B:
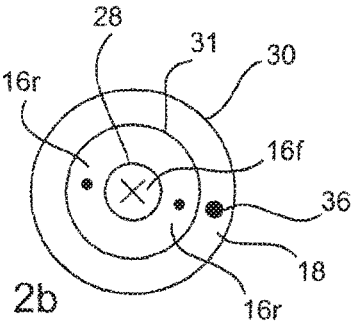
FIG. 2*b* is a cross sectional view through a drill string of the drilling system shown in FIG. 2*a*; and, FIG. 3 is a cross section view of a drill string/drill pipe assembly for a third embodiment of the drilling system.

FIGS. 2*a* and 2*b* depict a further embodiment of a ground drilling system designated by the reference number 10'. The drilling system 10' differs from the drilling system 10 by the provision of a return path for the working fluid to enable the working fluid to be recirculated through the system 10'. This is to be contrast with the system 10 where the working fluid 34 is exhausted from the drilling tool 12 into the hole and subsequently mixed with the flushing fluid 36 and returned to the ground. To enable recirculation of the working fluid 34 the working fluid flow path 16' constituted by a feed path 16*f* which is identical to the path 16 of the system 10; and a working fluid return path 16*r*. Both paths 16*f* and 16*r* are in communication with the drilling tool 12 so that the working fluid 34 is fed through the flow path 16*f* and returns to the surface via the working fluid return path 16*r*. The fluid return path 16*r* is formed in this embodiment by the provision of an intermediate conduit 31 disposed concentrically with and intermediate the inner conduit 28 and the outer conduit 30. The conduits 28 and 31 are dimensioned so as to form an annular space there-between which constitutes the working fluid return path 16*r*. An annular space is also formed between the outer surface of the intermediate conduit 31 and the inner surface of the outer conduit 30 to form the flushing fluid flow path 18.

The system 10' enables reuse of the working fluid 34. Thus control of hole pressure conditions within the hole, up hole velocity, and hole stability is via manipulation or other modification of the parameters or characteristics of the flushing fluid 36.

Figure 3:
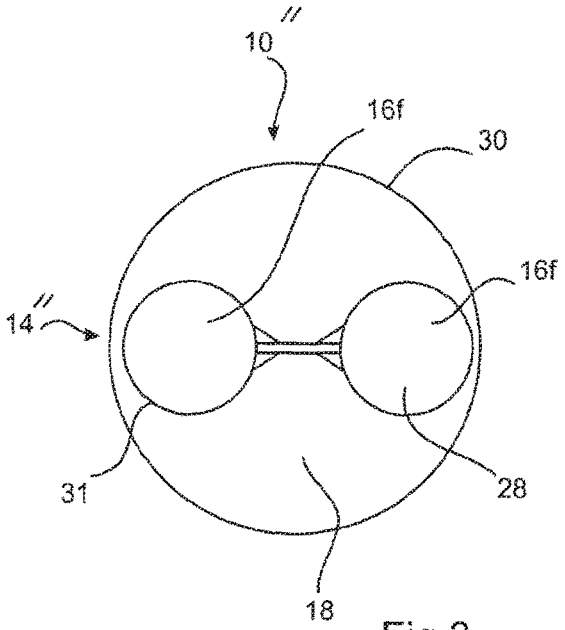

FIG. 3 illustrates a drill string 14" of a third embodiment of a ground drilling system denoted by the reference number 10". The system 10" is also formed with a closed loop flow path for the working fluid but does so with a drill string structure 14" different to that of the second embodiment 10'. In the system 10", the working fluid flow path comprises two conduits 28 and 31 both disposed inside of outer conduit 30. The conduit 28 provides the working fluid feed path 16*f* while the conduit 31 provides the working fluid return path 16*r*. Both of the conduits 28 and 31 are in fluid communication with the drilling tool 12 so that the working fluid 34 flows from an up hole end of the drill string 14" through the conduit 28 and working fluid feed path 16*f*, through the tool 12 to operate the tool, and back up the drill string 14" through the conduit 31 and associated working fluid return path 16*r*. The flushing fluid 36 is delivered through the conduit 30 and exhausted into the hole. It will be appreciated that the working fluid flow paths 16*r* and 16*f* remain isolated from the flushing fluid flow path 18 and thus the working fluid and flushing fluid remain isolated from each other at least during their flow within the drill pipe 14".

The system 10" is well suited for single pass drilling operations where the drill string 14" is in essence a single length pipe assembly extending from the drilling tool 12 to the rotation head 22 (i.e. no additional drill pipes are added to the drill string) and a drilling operation involves only drilling to a depth less than the total length of the tool 12 and the drill pipe assembly. This type of drilling is commonly used on production drilling on benches with heights of up to about 18 m and is very efficient as it eliminates the making and breaking of drill pipe connections as well as eliminating spillage and contamination of the working fluid.

The above described embodiments of the ground drilling system and associated drilling method are particularly well suited to oil and gas operations in hard ground formations. In particular embodiments of the system and method enable the use of down the hole drilling tools in the form of down the hole hammers which are very well suited to drilling in hard materials although do not find favour when drilling for oil/gas due to the trade off between longevity of the drilling tool and the ability to control down hole pressure and maintain hole stability. For example to drill with a marginal under pressure, when using a regular DTH hammer, it may be required to operate the hammer with a fluid of a relatively high specific gravity. This will entail using a mud or slurry to drive the hammer. However by its very nature the mud or slurry will contain particles that abrade and wear the hammer. As a result it becomes necessary to trip the drill string more regularly in order to replace the worn hammer. When a hole is several kilometers deep, the tripping of the drill string may take up to or exceed 24 hours. However if a working fluid of lower specific gravity is used then the ability to provide a specific pressure condition may be lost. Embodiments of the system and method enable separate provision and control of the parameters and characteristics of the working and flushing fluids thereby enabling maximum efficiency and longevity of the down hole tool while also providing control over down hole pressure and hole stability.

While specific system and method embodiments have been described, it should be apparent that the system and method may be embodied in other forms. For example an embodiment of the system 10 is described with the drilling tool 12 being the form of a water hammer. However the drilling tool may be in the form of other fluid operated percussion tools. Further, the fluid 34 flowing through the working fluid flow path 16 which operates the drilling tool 12 may be in the form of a gas. Providing the working and flushing fluids at the same fluid pressure results in a zero pressure differential between fluid flow paths 16 and 18 and assist in maintaining seal integrity. Nevertheless this is not an absolute requirement and the working and flushing fluids may be provided at different pressures.

In the claims which follow, and in the preceding description, except where the context requires otherwise due to express language or necessary implication, the word "comprise" and variations such as "comprises" or "comprising" are used in an inclusive sense, i.e. to specify the presences of the stated feature but not to preclude the presence or addition of further features in various embodiments of the system and method as disclosed herein.

The invention claimed is:

1. A method of drilling a hole in the ground using a fluid operated water hammer, the method comprising:

delivering a working fluid through a drill string to the water hammer to operate the water hammer, wherein the working fluid comprises water or oil or a mixture thereof;

delivering a flushing fluid through the drill string toward the water hammer, wherein the flushing fluid while flowing in the drill string is isolated from the working fluid; and, releasing the flushing fluid from a location that is fixed with respect to the water hammer and up hole thereof, wherein the location advances with the drill string, and wherein the flushing fluid is released adjacent to the water hammer near a bottom of the hole being drilled.

2. The method according to claim 1 comprising releasing the working fluid into the hole near a toe of the hole to enable mixing of the working fluid and the flushing fluid in the hole.

3. The method according to claim 1 comprising recirculating the working fluid through the drill string wherein the working fluid is not mixed with the flushing fluid in the hole.

4. The method according to claim 1 comprising adjusting down hole pressure by varying a physical characteristic of one or both of the flushing fluid and the working fluid.

5. The method according to claim 4 where adjusting down hole pressure comprises adjusting one or both of the specific gravity and the viscosity of the flushing fluid.

6. The method according to claim 4 wherein adjusting down hole pressure comprising dynamically adjusting down hole pressure to provide one of: an underbalanced pressure condition in the hole; an overbalanced pressure condition in the hole; and a balanced pressure condition in the hole.

7. The method according to claim 1 comprising changing a direction of flow of the flushing fluid from a down hole direction to an up hole direction prior to releasing the flushing fluid into the hole.

8. The method according to claim 4 comprising providing the working and flushing fluids as fluids of: different specific gravity; or different viscosity; or both different specific gravity and different viscosity.

9. The method according to claim 1 wherein the flushing fluid is provided as one or a combination of one or more of: a drilling mud, water, and aerated water.

10. The method according to claim 1 comprising providing the working and flushing fluids at the same pressure.

* * * * *